US006991348B2

(12) United States Patent
Titmarsh

(10) Patent No.: US 6,991,348 B2
(45) Date of Patent: Jan. 31, 2006

(54) LIGHT COVER WITH DOUBLE RAILED SEALING EDGE

(75) Inventor: Brian V. Titmarsh, Totowa, NJ (US)

(73) Assignee: Paraflex Lighting Nordex, Totowa, NJ (US)

( * ) Notice: Subject to any disclaimer, the term of this patent is extended or adjusted under 35 U.S.C. 154(b) by 0 days.

(21) Appl. No.: 10/423,782

(22) Filed: Apr. 25, 2003

(65) Prior Publication Data

US 2004/0212999 A1 Oct. 28, 2004

(51) Int. Cl.
*F21V 3/00* (2006.01)

(52) U.S. Cl. ..... 362/317; 362/147; 362/309; 362/408

(58) Field of Classification Search ..... 362/147, 362/307, 308, 309, 310, 317, 331, 332, 336, 362/337, 338, 339, 340, 408
See application file for complete search history.

(56) References Cited

U.S. PATENT DOCUMENTS 4,462,068 A * 7/1984 Shadwick ..... 362/332
4,633,377 A * 12/1986 Mackiewicz ..... 362/309
6,332,637 B1 * 12/2001 Chambers ..... 296/3

* cited by examiner

*Primary Examiner*—John Anthony Ward
(74) *Attorney, Agent, or Firm*—Pitney Hardin LLP

(57) ABSTRACT

A light cover, such as a prismatic lens, includes a generally planar rectangular floor with curved walls rising from a periphery of the floor. The curved walls terminate in outwardly turned flanged-type lips create an upper periphery or opening of the lamp cover. A pair of parallel or spaced apart rails extend around the upper periphery. An interstice is formed between the pair of rails. When the outwardly turned flange-type lips are urged against a sealing or washer-type material, the sealing or washer-type material is urged into the interstice thereby forming an improved watertight seal.

11 Claims, 5 Drawing Sheets

LIGHT COVER WITH DOUBLE RAILED SEALING EDGE

BACKGROUND OF THE INVENTION

1. Field of the Invention

The invention relates to a light cover, such as a prismatic lens, particularly for fluorescent or similar lights, which uses a double rail configuration on the edges to provide an improved watertight seal, particularly for use in car washes or other similar wet environments.

2. Description of the Prior Art

In the prior art, light covers, such as prismatic lenses, which require a relatively waterproof seal are known. However, in some particularly wet environments, such as car washes, improvements in the watertight sealing, while retaining a simple assembly and disassembly process, are desired.

OBJECTS AND SUMMARY OF THE INVENTION

It is therefore an object of the present invention to provide a light cover, such as a prismatic lens, with an improved watertight seal for use in particularly wet applications.

It is therefore a still further object of the present invention to provide a light cover, such as a prismatic lens, with an improved watertight seal, which retains a simple assembly and disassembly process.

It is therefore a still further object of the present invention to provide a light cover, such as a prismatic lens, which achieves the above objects with little or no increase in cost or manufacturing complexity.

These and other objects are attained by providing a light cover, such as a prismatic lens, which has a generally planar surface with walls extending from the periphery of the planar surface and terminating in an out-turned lip, wherein the periphery of the out-turned lip defines an open end which is secured to an upper half of a light fixture, a ceiling or similar architectural structure with a sealing or washer-like material between the lip and the upper half of the light fixture, the ceiling or similar architectural structure. The apex of the out-turned lip includes two ridges or rails which are generally parallel to each other or spaced apart from each other and extend around the apex of the out-turned lip. An interstice is formed between the two rails. When clips or similar devices engage the out-turned lip so as to secure the light cover to the upper half of the light fixture, the ceiling or similar architectural structure with the sealing or washer-like material therebetween, the two ridges or rails are oriented so as to be urged against the sealing or washer-like material thereby urging the sealing or washer-like material into the interstice and forming an improved watertight seal. The resulting structure requires no change to the clips or similar devices which are used to secure the light cover to the upper half of the light fixture, the ceiling or similar architectural structure, and requires little or no change to the sealing or washer-like material between the upper half of the light fixture or the ceiling and the light cover.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
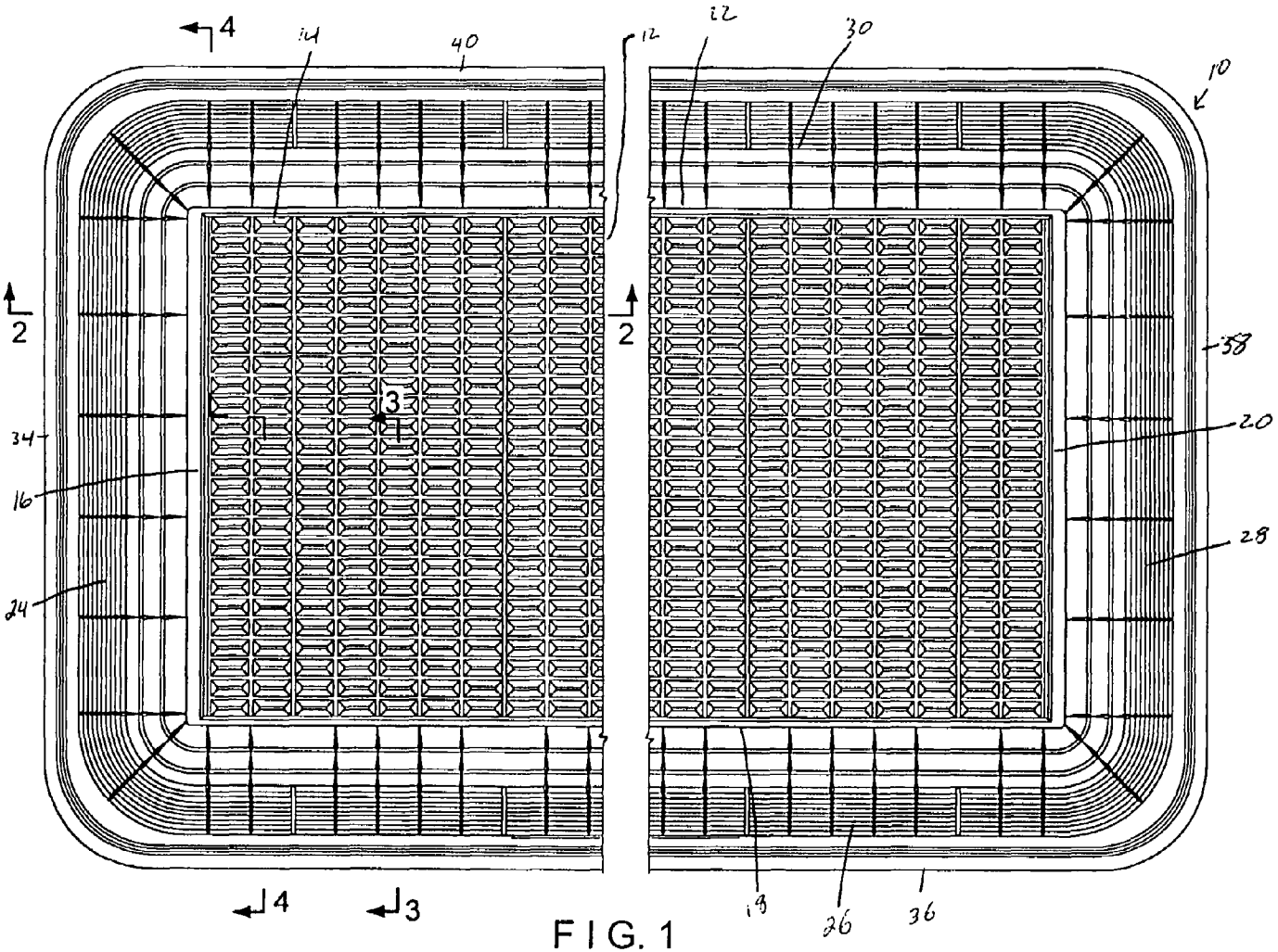
FIG. 1 is a fragmented plan view of the bottom exterior of the lighting cover of the present invention.
Figure 2:
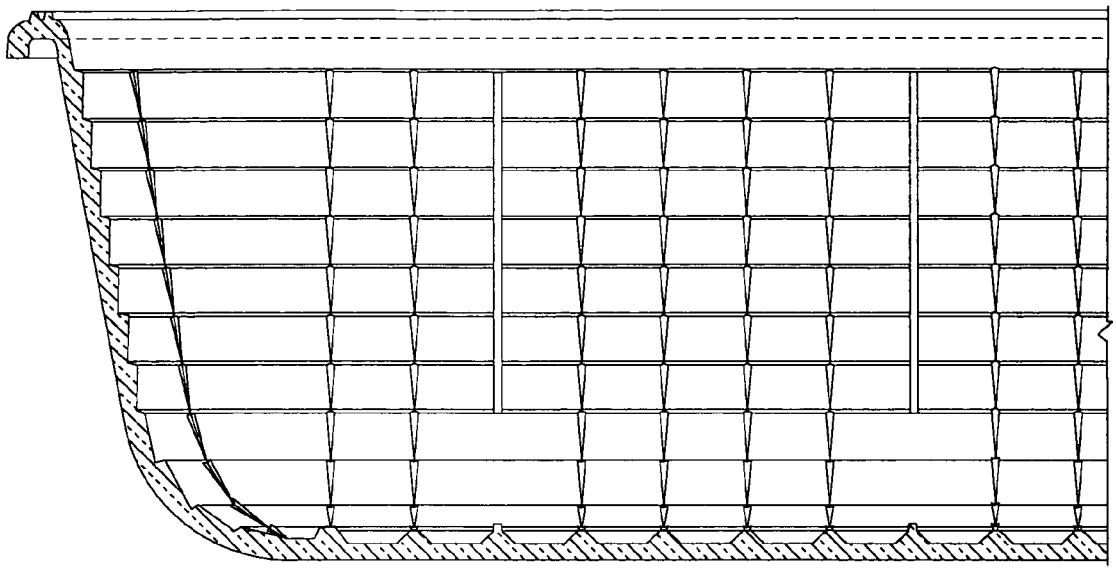
FIG. 2 is a cross-sectional view along plane 2—2 of FIG. 1.
Figure 3:
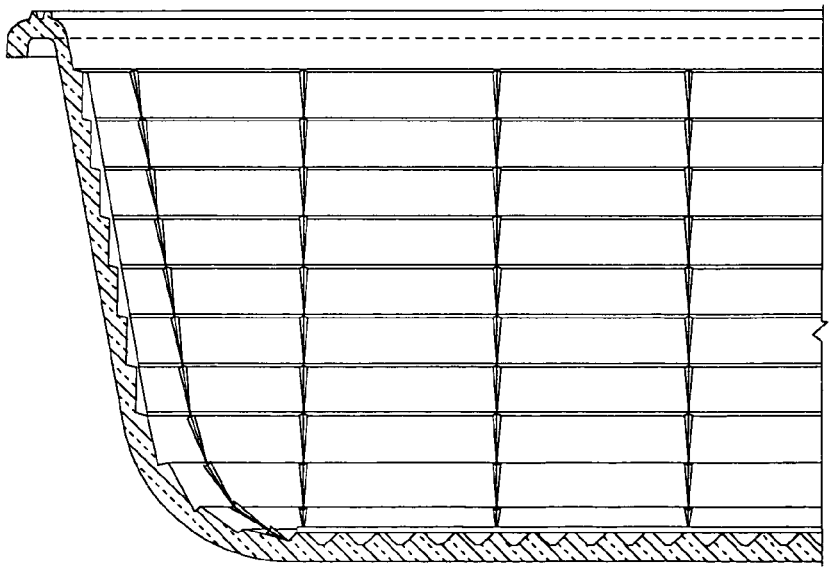
FIG. 3 is a cross-sectional view along plane 3—3 of FIG. 1.
Figure 4:
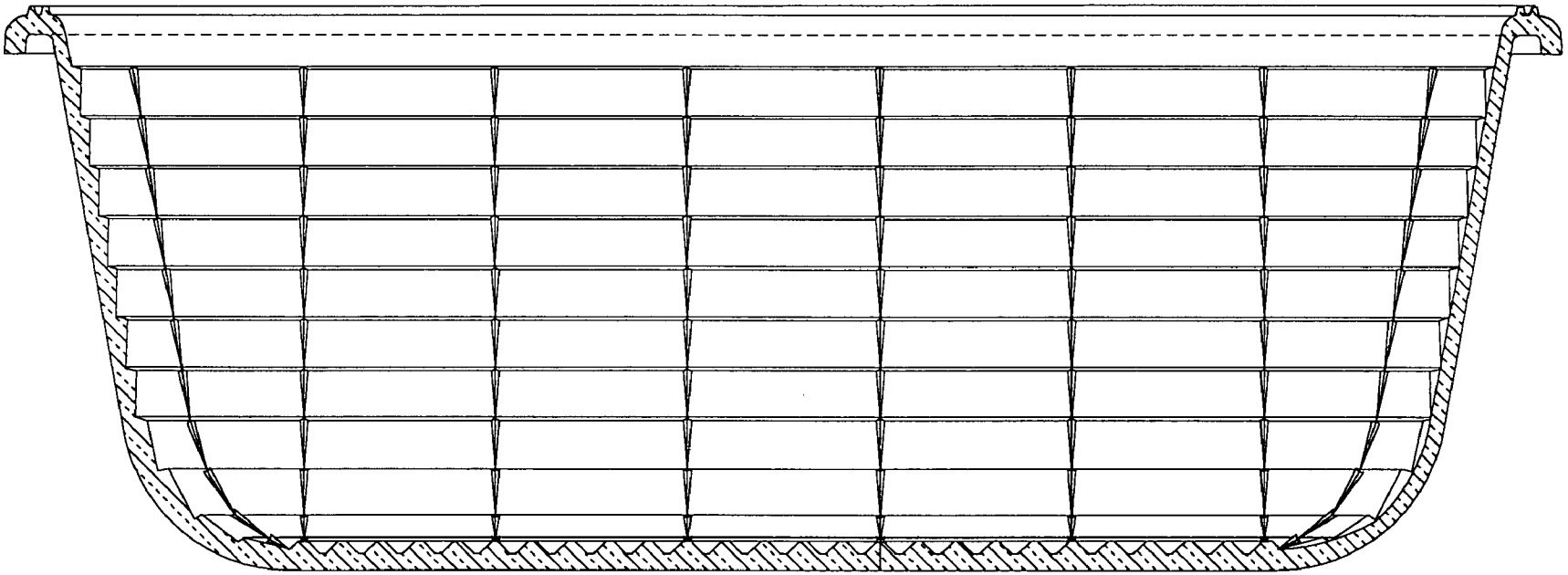
FIG. 4 is a cross-sectional view along plane 4—4 of FIG. 1.

Referring now to the drawings in detail wherein like numerals indicate like elements throughout the several views, FIG. 1 is a fragmented plan view of the bottom exterior of the lighting cover 10 of the present invention. FIGS. 2–6 show various cross-sectional views while FIG. 7 shows an illustrative set of proportions for the lighting cover 10.

Lighting cover 10 is typically made from clear polycarbonate F1 rated for UV protection or clear acrylic with a 15% DR content. However, those skilled in the art, after review of this disclosure, will recognize that a range of materials may be substituted for these materials.

Lighting cover 10 includes a generally rectangular planar floor 12. A cartesian-like array of prismatic elements 14 with tapered sides and an elongated peak is formed on the upper or interior side of planar floor 12. The prismatic elements 14 serve to disperse the light from a bulb 200 (shown in phantom in FIG. 6), typically a fluorescent bulb, which is ultimately enclosed within the light cover 10 in the installed orientation or configuration shown in FIG. 7. Planar floor 12 is bounded by end portions 16, 20 and side portions 18, 22. Curved walls 24, 26, 28, 30 arise from portions 16, 18, 20, 22, respectively. The interior surfaces of curved walls 24, 26, 28, 30 similarly include interior prismatic faces 32 to diffuse and disperse the light from a bulb 200 (shown in phantom in FIG. 5) enclosed therewith. Curved walls 24, 26, 28, 30 terminate in outwardly flared flange-type lips 34, 36, 38, 40 respectively, which form the generally rectangular upper periphery which is urged against a sealing or washer-like material 100 (see FIG. 6) in the installed configuration.

As shown in FIGS. 2–6, the uppermost portion of outwardly flared flanged-type lips 34, 36, 38, 40 includes two rails 42, 44 which are spaced apart and extend continuously around the generally rectangular upper periphery formed by outwardly flared flanged-type lips 32, 34, 36, 38. Interstice 46 is formed between rails 42, 44 and likewise extends about the generally rectangular upper periphery.

Figure 6:
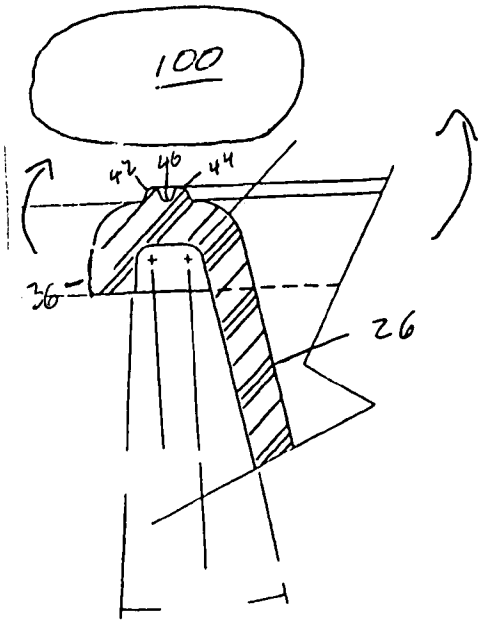
FIG. 6 is a detailed cross-sectional view of a portion of FIG. 5, showing a fluorescent bulb in phantom and further showing the detail of the double rail system, particularly with respect to the sealing or washer-like material used during installation.
Figure 5:
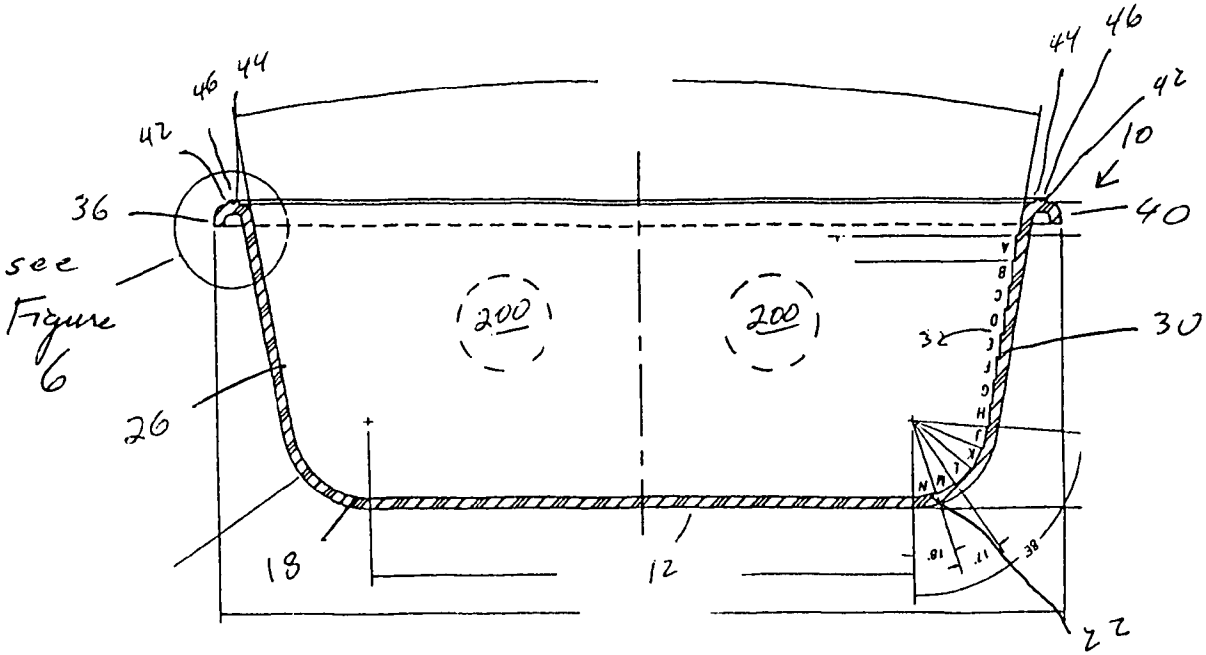
FIG. 5 is a cross-sectional view of the lighting cover of the present invention.
Figure 7:
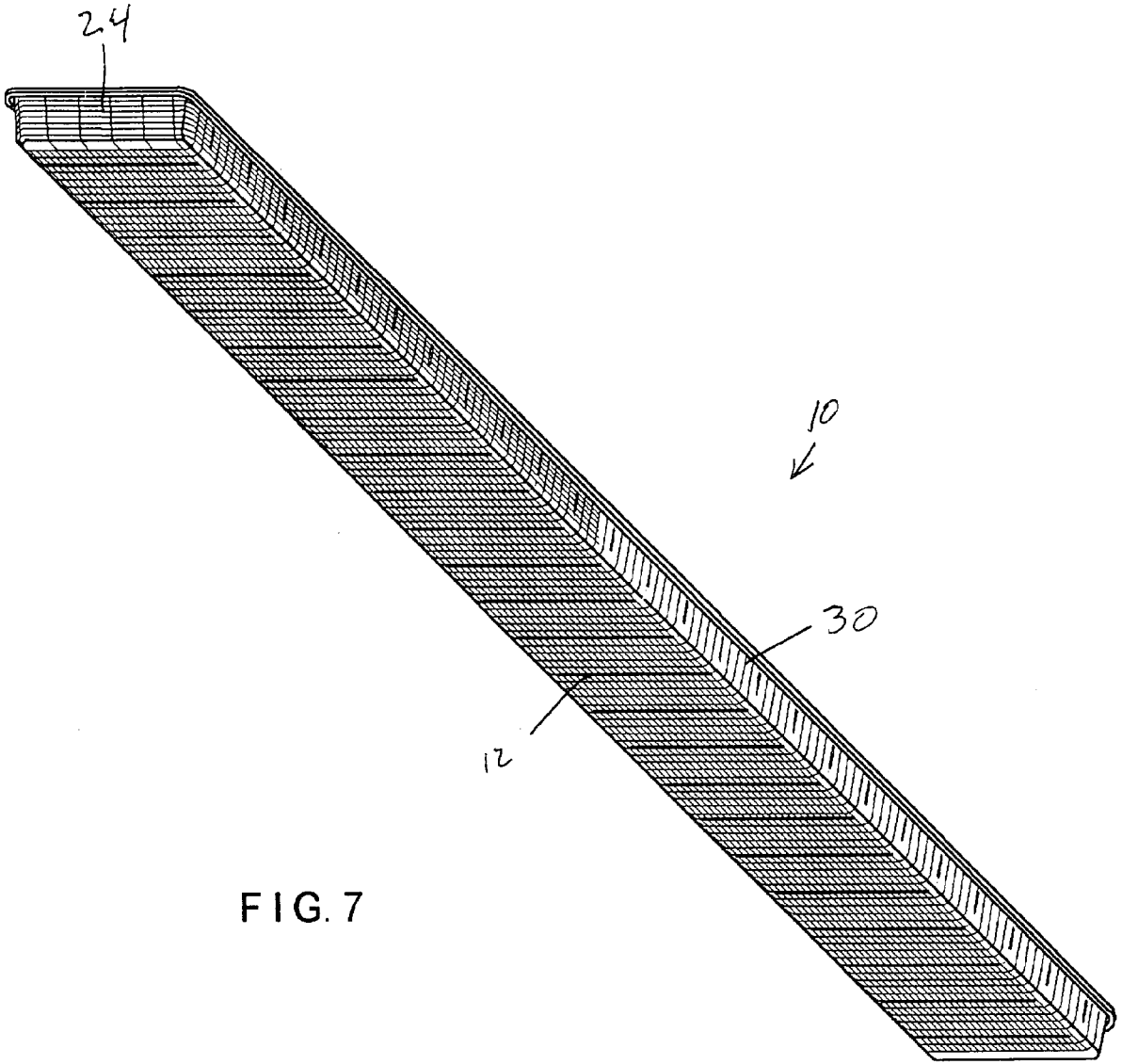
FIG. 7 is a perspective view of a light cover of the present invention, shown in an installed configuration or orientation, with an illustrative set of proportions.

As shown in FIG. 6, in the installed configuration, outwardly flared lips 34, 36, 38, 40 and particularly rails 42, 44 are urged against sealing or washer-like material 100. Clips or similar hardware (not shown) are used to engage outwardly flared flanged-type lips 34, 36, 38, 40 to the upper half of the light fixture, the ceiling or similar architectural structure (not shown). As rails 42, 44 are urged against the sealing or washer-like material 100, a portion of the sealing or washer-like material 100 is urged into interstice 46. This portion of material 100 urged into interstice 46 causes a serpentine interface between lighting cover 10 and material 100 to be formed thereby greatly increasing its watertight characteristics.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A light cover for an illuminating device, comprising:

a floor for positioning below the illuminating device, with light passing through said floor, walls rising from a periphery of said floor and terminating in a lip, said lip forming an upper periphery outward of the illuminating device, and two closely-spaced parallel rails extending about said upper periphery with an interstice formed between said rails, whereby when said lip, said rails and said upper periphery are urged against sealing material, the sealing material is urged into said interstice, thereby resulting in a substantially watertight seal.

2. The light cover of claim 1 wherein said lip forms an outwardly turned flange structure throughout said upper periphery.

3. The light cover of claim 2 wherein said floor is generally planar.

4. The light cover of claim 3 wherein said floor is generally rectangular.

5. A light cover, comprising:

a generally planar rectangular floor, walls rising from a periphery of said floor of the light cover and terminating in a lip, said lip forming an upper periphery, and two closely-spaced parallel rails extending about said upper periphery with an interstice formed between said rails, whereby when said lip, said rails and said upper periphery are urged against sealing material, the sealing material is urged into said interstice, thereby resulting in a substantially watertight seal;

wherein said lip forms an outwardly turned flange structure throughout said upper periphery;

wherein said floor includes an array of prismatic structures.

6. The light cover of claim 5 wherein said prismatic structures are formed on an interior surface of said floor.

7. The light cover of claim 6 wherein said array is substantially cartesian.

8. The light cover of claim 7 wherein said walls are generally curved.

9. The light cover of claim 8 wherein said walls include a prismatic configuration.

10. The light cover of claim 9 wherein said prismatic configuration is formed on an interior of said walls.

11. The light cover of claim 9 wherein said light cover is formed a material chosen from the group consisting of polycarbonate and acrylic.

* * * * *